US011325384B2

(12) United States Patent
Boerma et al.

(10) Patent No.: US 11,325,384 B2
(45) Date of Patent: May 10, 2022

(54) METHOD AND MECHANISM FOR CONTACTLESS CLEANING OF A NOZZLE PLATE

(71) Applicant: IAI industrial systems B.V., Veldhoven (NL)

(72) Inventors: Erik Niels Boerma, Eindhoven (NL); An Prenen, Kaullille (BE)

(73) Assignee: IAI industrial systems B.V., Veldhoven (NL)

( * ) Notice: Subject to any disclaimer, the term of this patent is extended or adjusted under 35 U.S.C. 154(b) by 0 days.

(21) Appl. No.: 16/505,940

(22) Filed: Jul. 9, 2019

(65) Prior Publication Data

US 2021/0008888 A1 Jan. 14, 2021

(51) Int. Cl.
*B41J 2/165* (2006.01)

(52) U.S. Cl.
CPC ..... *B41J 2/16552* (2013.01); *B41J 2/16532* (2013.01); *B41J 2002/1657* (2013.01); *B41J 2002/16555* (2013.01)

(58) Field of Classification Search
None
See application file for complete search history.

(56) References Cited

U.S. PATENT DOCUMENTS

| | | | | |
|---|---|---|---|---|
| 1,353,431 | A * | 9/1920 | Sims | B04C 5/13 55/431 |
| 4,012,847 | A * | 3/1977 | Rand | F26B 21/08 34/75 |
| 6,561,621 | B2 * | 5/2003 | Webster | B41J 2/16508 347/34 |
| 8,240,808 | B2 * | 8/2012 | Sasayama | B41J 2/16552 347/30 |
| 8,342,641 | B2 * | 1/2013 | Pons | B41J 2/18 347/36 |
| 8,506,662 | B2 * | 8/2013 | Makinen | B01D 45/08 55/338 |
| 9,538,891 | B2 * | 1/2017 | Griffith | B01D 45/16 |
| 2003/0179260 | A1 * | 9/2003 | Anderson | B41J 2/20 347/25 |

* cited by examiner

*Primary Examiner* — Alejandro Valencia
(74) *Attorney, Agent, or Firm* — Schwegman Lundberg & Woessner, P.A.

(57) ABSTRACT

A method for contactless cleaning of a nozzle plate of a print head. The method may include: providing a suction element, the suction element causing a fluid to flow along a surface of the nozzle plate and toward the suction element for removing residue from the nozzle plate; sucking-in, by the suction element, the fluid together with the removed residue; and separating the sucked-in fluid from the sucked-in residue. Also, a suction element for cleaning of such a nozzle plate. The suction element may be configured to cause a fluid to flow along a surface of the nozzle plate and toward the suction element for removing residue from the nozzle plate and sucking-in the fluid with the residue. The suction element may include a mouth piece and a wheel, the wheel being arranged such that the mouth piece is spaced away from the surface of the nozzle plate.

15 Claims, 2 Drawing Sheets

METHOD AND MECHANISM FOR CONTACTLESS CLEANING OF A NOZZLE PLATE

FIELD

The disclosure relates to a method and a mechanism for contactless cleaning of a nozzle plate of a print head. The print head may be a print head for UV curable ink in-system but is not limited thereto.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In the above defined field, an automated cleaning function for cleaning print heads for UV curable ink in-system is generally known. In an automated cleaning function, generally no operator labor is involved in cleaning the print head except maybe starting the process via a human machine interface. In the present case, it is one of the objects of the invention to provide such an automated cleaning function wherein the print head is cleaned without touching a nozzle plate thereof and without using flush or similar chemicals.

SUMMARY

A method for contactless cleaning of a nozzle plate of a print head is described herein. The method may comprise a step of providing a suction element, the suction element causing a fluid, preferably air, to flow along a surface of the nozzle plate and then toward the suction element for removing residue from the nozzle plate. The method may further comprise a step of sucking-in, by the suction element, the fluid together with the removed residue, and a step of separating the sucked-in fluid from the sucked-in residue.

The sucked-in fluid may act as a carrier for the sucked-in residue. The fluid flow may be caused by a vacuum. In this context, a vacuum may be an underpressure of 100 mbar or less. The suction element may also be called a suction mouth or air inlet. The nozzle plate may be the part of the print head comprising cavities from which ink is jetted. The nozzle plate is typically the most vulnerable part of the print head. The method may be carried out periodically, e.g. on a daily basis, to ensure constant quality of prints. The method may be started by an operator. Cleaning the print head may include removing residue, such as ink. Contactless may mean that the suction element does not touch or come into contact with the surface of the nozzle plate. Contactless may also mean that a surrounding of the print head comprising a sensitive coating is not touched. The surface to be cleaned may be the surface of the nozzle plate where cavities for injecting ink are located.

The method may comprise a step of circulating ink in the print head to remove micro bubbles. The step of circulating ink may be carried out before the step of sucking-in. The method may comprise a step of purging the print head to force ink out, flushing residue from the surface of the nozzle plate. The step of purging the print head may be carried out before the step of sucking-in. The ink that falls from the print head during the step of circulating ink and/or the step of purging may be collected in a purge tray, which in some instances may preferably comprise a sponge.

The method may comprise a step of collecting the sucked-in residue separated from the sucked-in fluid. Sucked-in may describe a state where the respective element, e.g. the fluid and residue, have reached the suction element, i.e. are inside the suction element. Collecting the sucked-in residue may make it possible for an operator to dispose of this residue.

The method may comprise a step of outputting the sucked-in fluid separated from the sucked-in residue. The sucked-in fluid may be output to an environment where the print head is installed, e.g. a production hall or any other closed room. The sucked-in fluid may be discharged by the pump, which may also cause the fluid flow along the surface of the nozzle plate.

The method may comprise moving the suction element relative to the surface of the nozzle plate during the step of sucking-in the fluid together with the removed residue.

Moving the suction element may generally comprise three sub-steps or strokes. A first sub-step may be, in comparison to the other sub-steps, a fast one with respect to a flow velocity of the fluid flow and/or a speed moving the suction element relative to the surface of the nozzle plate, and may preferably suck-in substantially all ink droplets hanging from the surface of the nozzle plate. The first sub-step may be done within about 20 seconds or other suitable time period of ending purging and/or circulation. A goal of the first sub-step may be to remove the ink droplets before they retract through capillary forces since retraction may cause dirt in the ink to be placed back onto the nozzle plate. A second sub-step may be done with a speed, in some instances preferably a constant speed, being greater than or equal to about 0.5 mm/s and less than or equal to about 3.0 mm/s, and in some instances is preferably about 1.0 mm/s. A third sub-step may be done over a distance that is shorter than a length of the surface of the nozzle plate. The third sub step may be done to remove ink droplets left behind at the end of a previous cleaning round. More specifically, when turning off the vacuum or pulling down the suction element, some ink droplets may remain in a dead spot of the air flow above a middle line of the suction element. This position may be placed next to the surface of the nozzle plate, in a recess, so these ink droplets may stay in place during printing. In the next cleaning cycle, the suction mouth may pass this same spot twice before leaving the spot. The middle line may be a parallel to a vertical direction and/or perpendicular to the surface of the nozzle plate.

The method may comprise moving the suction element relative to the surface of the nozzle plate during the step of sucking-in with a distance, in some instances preferably a constant distance, from the surface of the nozzle plate being larger than or equal to about 0.15 mm and smaller than or equal to about 0.35 mm, and in some instances is preferably about 0.2 mm. The distance may be constant over a length of the surface of the nozzle plate.

The residue may comprise at least one of ink, cured ink, semi-cured ink, particles, or fibers.

The method may comprise using a cyclone-principle for separating the sucked-in fluid from the sucked-in residue. The cyclone-principle may be described as using a substantially circular cavity in which a fluid-residue mixture is let in near a bottom thereof and a clean fluid, i.e. the part of the sucked-in fluid that is substantially residue free, is removed at top thereof. Thereby a centrifugal force may be generated on the fluid such that the dirty fluid, i.e. the part of the sucked-in fluid carrying the residue, is removed together with the residue therein at a bottom of the separator. A separator using the cyclone-principle may also be called a fluid-residue separator or, in case the fluid is air, air-residue separator.

A cleaning device for contactless cleaning of a nozzle plate of a print head is also described herein. The device may comprise a suction element and a separator. The suction element may be configured to cause a fluid to flow along a surface of the nozzle plate and then toward the suction element for removing residue from the nozzle plate. The suction element may be further configured to suck-in the fluid together with the removed residue. The separator may be connected to the suction element and configured to separate the sucked-in fluid from the sucked-in residue. The amount of fluid caused to flow along the surface of the nozzle plate and then toward the suction element may be preset with respect to a separating capacity of the separator. The cleaning device may be configured to carry out at least one of the above described methods.

As described above, the separator may be configured to separate the sucked-in fluid from the sucked-in residue by using a cyclone-principle. The separator may comprise a cone shaped part in the middle of a cyclone chamber for creating a cyclone in the cyclone chamber.

The cleaning device may comprise a filter device arranged downstream the separator and connected to the separator. The filter device may be configured to remove aerosols from the sucked-in fluid. The filter device may be an active carbon filter. The active carbon filter may be removeable. The aerosols may a be suspension of solid particles and/or liquid droplets in the fluid.

The cleaning device may comprise a pump arranged downstream the filter device and connected to the filter device. The pump may be configured to discharge the sucked-in fluid to an environment external the cleaning device.

The suction element may be configured to cause the fluid to flow along the surface of the nozzle plate with a predetermined fluid velocity based on, or calculated based on, a gap surface between the suction element and the surface of the nozzle plate. The fluid velocity may be greater than or equal to about 18 m/s and less than or equal to about 53 m/s, and in some instances is preferably around 22 m/s.

An outlet of the separator may be connected to a bin for the sucked-in residue and a bypass circuit may be provided parallel to the separator for generating underpressure in the bin such that the sucked-in residue is sucked into the bin from the separator. The bin may be removable. Additionally or alternatively, an underpressure generating device may be provided. The underpressure generating device, e.g. a pump, may be configured to generate the underpressure in the bin such that the sucked-in residue is sucked into the bin from the separator.

A suction element for contactless cleaning of a nozzle plate of a print head is also described herein. The suction element may be configured to cause a fluid to flow along a surface of the nozzle plate and then toward the suction element for removing residue from the nozzle plate and suck-in the fluid together with the removed residue. The suction element may comprise a mouth piece and at least one wheel. The wheel may be arranged such that the mouth piece is spaced away from the surface of the nozzle plate.

Keeping the distance with the at least one wheel provides the advantage that variations or tolerances in positioning of the print head are singled out and it allows to change the distance by changing a geometry of the nozzle plate, which may be a removable part.

Two wheels may be provided. A diameter of the at least one wheel may be chosen in such a way that when the nozzle plate is moved over an edge of the print head, onto a base plate, the nozzle plate will not come into contact with a side thereof. This may be at a distance from the cleaning nozzle to the print head of about 0.2 mm.

The suction element may be provided with a spring system for pushing the mouth piece toward the surface of the nozzle plate. The mouth piece may be removable.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying figures, in which:

DETAILED DESCRIPTION

Figure 1:
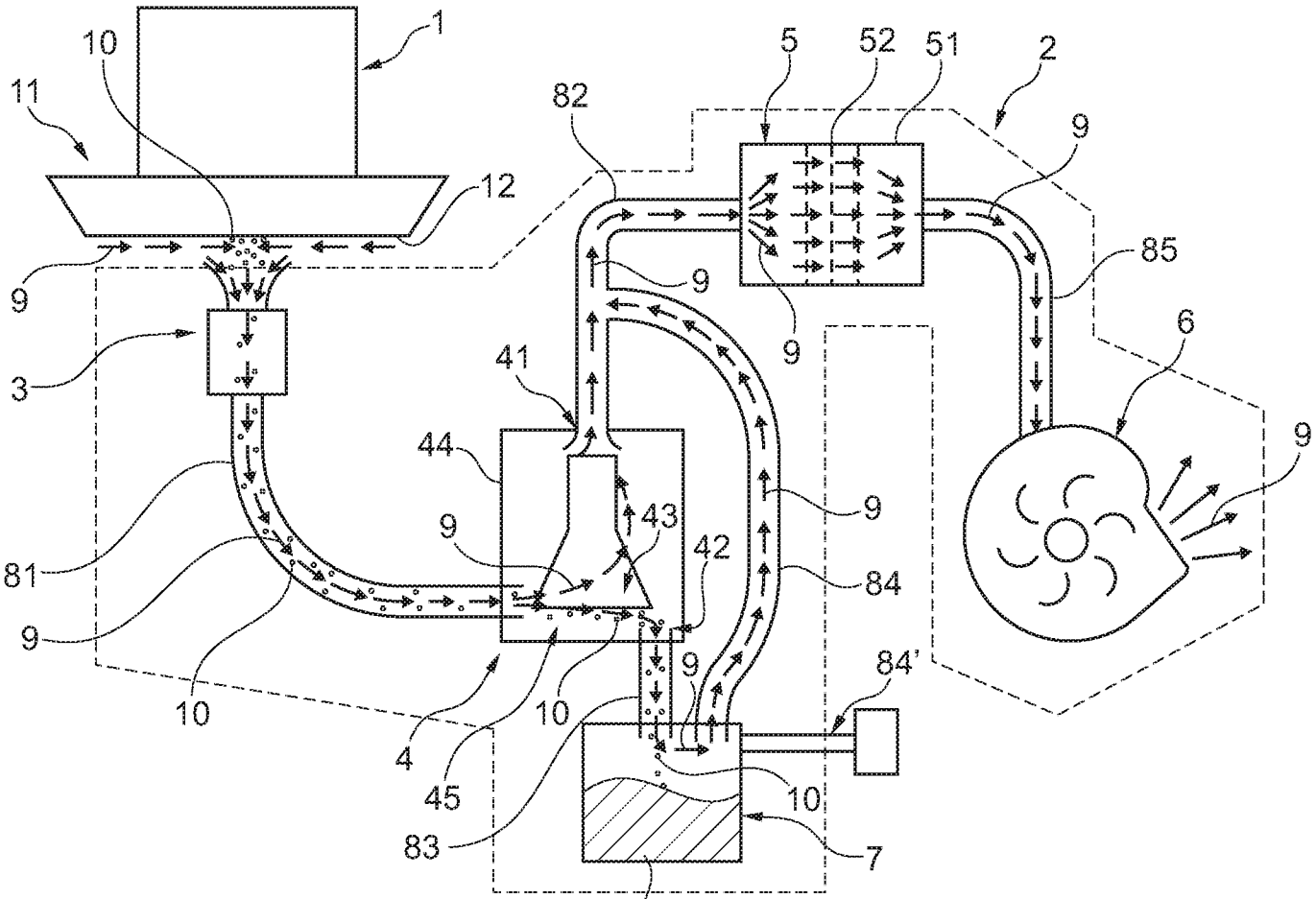
FIG. 1 depicts schematically a cleaning device for contactless cleaning of a nozzle plate of a print head according to one embodiment.

A cleaning device 2 for contactless cleaning of a nozzle plate 11 of a print head 1 according to one embodiment will be described with reference to FIG. 1.

The print head 1 comprises the nozzle plate 11 and a nozzle plate surface 12.

The cleaning device 2 may comprise a suction element 3, a separator 4, a filter device 5, a pump 6, and a bin 7. The separator 4 may be located downstream the suction element 3. The filter device 5 may be located downstream the separator 4. The bin 7 may be located downstream the separator 4. The pump 7 may be located downstream the filter device 5.

An inlet of the separator 4 may be connected to the suction element 3 via a first tubing 81. One outlet 41 of two outlets 41, 42 of the separator 4 may be connected via a second tubing 82 to an inlet of the filter device 5. The other outlet 42 of the two outlets 41, 42 of the separator 4 may be connected via a third tubing 83 to an inlet of the bin 7. An outlet of the bin 7 may be connected to the second tubing 82 via a fourth tubing 84. An outlet of the filter device 5 may be connected to an inlet of the pump 6 via a fifth tubing 85. An outlet of the pump 6 may be operably connected to an environment external the cleaning device 2.

In operation of the cleaning device 2, e.g. when the pump 6 is in operation, fluid 9 may be caused to flow along the nozzle plate surface 12 for removing residue 10 from the nozzle plate surface 12. The residue 10 comprises at least one of ink, cured ink, semi-cured ink, particles, or fibers. The fluid flow is indicated by arrows in FIG. 1, and the residue 10 is depicted by dots. The fluid 9 acts as a carrier for the residue 10 and transports the removed residue 10, e.g. the sucked-in residue 10, via the suction element 3 and the first tubing 81 to the inlet of the separator 4.

The separator 4 may comprise a cone shaped part 43 in the middle of a cyclone chamber 44 for creating a cyclone in the cyclone chamber 44. The separator 4 may be configured to separate that part of the sucked-in fluid 9 from sucked-in fluid not carrying the sucked-in residue 10 by using a cyclone-principle. This part of the sucked-in fluid 9 may be forced to move around by the cone shaped part 43 and may flow from the inlet of the separator 4 upward to the first outlet 41 to leave the separator 4 via the second tubing 82 to the inlet of the filter device 5. The sucked-in fluid 9 cannot, or generally won't, flow from the inlet straight up. Furthermore, under the cone shaped part 43, i.e. between the cone shaped part 43 and the bottom of the cyclone chamber 44, a low wind space 45 may be generated where the part of the sucked-in fluid 9 carrying the sucked-in residue 10 is not swept back up. In operation of the cleaning device 2, the cone shaped part 43 may be wet with sucked-in residue 10 around about a quarter or so of its circumference and halfway or so up the conical shape. This may generally provide an indication of good fluid-residue separation. The part of the sucked-in fluid 9 carrying sucked-in residue 10 may leave the separator 4 via the second outlet 42 located at or near the bottom of the cyclone chamber 44 via the third tubing 83 to the inlet of the bin 7. The fourth tubing 84 may act as a bypass over the cyclone camber 44 to remove the sucked-in fluid 9 carrying the sucked-in residue 10 from the cyclone chamber 44 in to the bin 7. The bypass 84 may use a pressure drop over the cyclone chamber 44 to create an underpressure in the bin 7. This underpressure is used to suck, e.g. remove, the sucked-in fluid 9 carrying the sucked-in residue 10 from the cyclone chamber 44. The use of this bypass 84 allows providing solely the pump 6. Inside the bin 7, separation may be done by using gravity force. Because a flow velocity inside the bin 7 may be relatively or comparatively lower, generally only the sucked-in fluid 9 leaves the bin 7 via its outlet, and generally no splattering occurs that would lead to airborne droplets. The bin 7 may also be called the second stage separator and the separator 4 may also be called the first stage separator. As an alternative solution, or additionally to the bypass 84, an additional underpressure generating device 84', e.g. a pump, may be provided.

The sucked-in air 9, without the sucked-in residue 10 being collected in the bin 7, may flow from the bin 7 via its outlet, the bypass 84, and the second tubing 82 to the inlet of the filter device 5. The filter device 5 may comprise a housing 52 and a filter, such as but not limited to, an active carbon filter, 51 inside the housing 52. The filter device 5 is provided since aerosols may be generated by high velocity of the fluid during sucking-in thereof. In some embodiments, the filter device 5 may be required to prevent such aerosols from entering the pump 6, due to a possible damage thereof, or exiting the cleaning device 2 into ambient or environmental air, due to health reasons.

The sucked-in fluid 9 generally without aerosols may flow after passing the filter device 5 via the fifth tubing 85 to the inlet of the pump 6 and may be released, e.g. discharged, into the ambient air, e.g. a surrounding environment.

A suction element 3 for contactless cleaning of the nozzle plate 11 of the print head 1 according to one embodiment will be described in detail with reference to FIG. 2.

Figure 2:
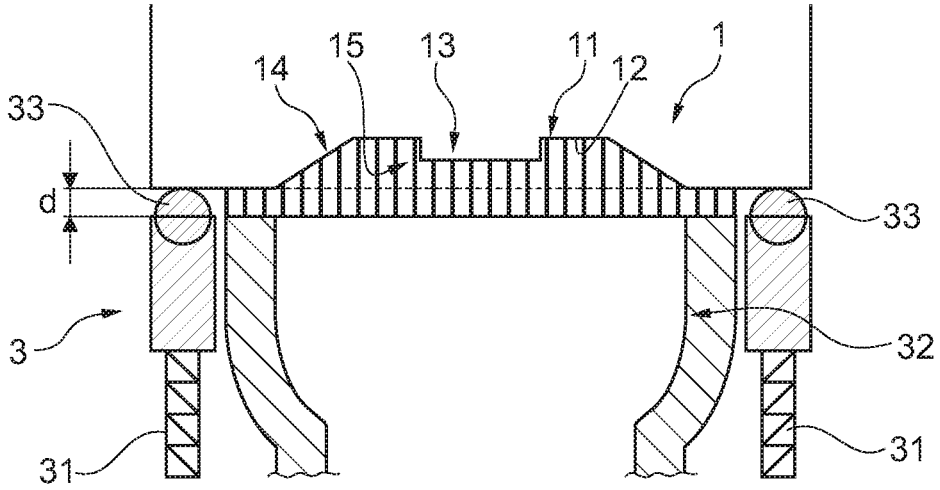
FIG. 2 depicts schematically a suction element for contactless cleaning of a nozzle plate of a print head according to one embodiment.

In FIG. 2, the print head 1 with the nozzle plate 11, the nozzle plate surface 12, and a nozzle 13 is schematically shown. The nozzle plate surface 12 may comprise a recess 14.

The suction element 3 may comprise a mouth piece 32 and one or more, e.g. two, wheels 33. The wheels 33 may be arranged such that the mouth piece 32 is spaced away from the surface 12 of the nozzle plate 11 by predetermined distance d. A spring system 31 may be provided for pushing the mouth piece 32 toward the nozzle plate surface 12.

As described above, the suction element 3 may be configured to cause the fluid 9 (see FIG. 1) to flow along the surface 12 of the nozzle plate 11 with a predetermined fluid velocity. The fluid velocity may be based on, or calculated based on, a gap surface 15 between the suction element 3 and the surface 12 of the nozzle plate 11, as indicated for example by the vertical hatching in FIG. 2. In an example case, the fluid velocity may be greater than or equal to about 18 m/s and less than or equal to about 53 m/s, and in some cases is preferably around 22 m/s.

Figure 3:
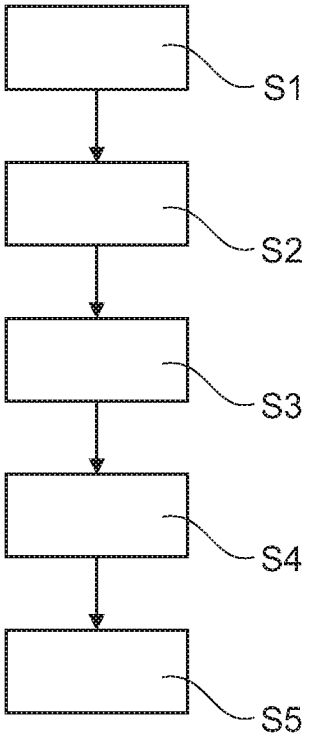
FIG. 3 depicts a flow diagram of a method for contactless cleaning of a nozzle plate of a print head according to one embodiment of the invention.

A method for contactless cleaning of the nozzle plate 11 of the print head 1 according to one embodiment will now be described with reference to FIGS. 1 and 3.

The method for contactless cleaning of the nozzle plate 11 may comprise a first step S1 of providing the above described suction element 3. The suction element 3 may cause the fluid 9 to flow along the surface 12 of the nozzle plate 11 and then toward the suction element 3 for removing residue 10 from the nozzle plate 11.

The method may comprise a second step S2 of sucking-in, by the above described suction element 3, the fluid 9 together with the removed residue 10 and a third step S3 of separating the sucked-in fluid from the sucked-in residue by using the above described first and second stage separators 4, 7. During the second step S2 of sucking-in the fluid 9 together with the removed residue 10, the suction element 3 may be moved relative to the surface 12 of the nozzle plate 11.

The suction element 3 may be moved relative to the surface 11 of the nozzle plate 12 during the second step S2 with a speed, in some cases preferably a constant speed, being greater than or equal to about 0.5 mm/s and less than or equal to about 3.0 mm/s, and in some cases is preferably about 1.0 mm/s. The suction element 3 may be moved relative to the surface of the nozzle plate 11 during the second step S2 with the constant distance d (see FIG. 2) from the surface 12 of the nozzle plate 11 being larger than or equal to about 0.15 mm and smaller than or equal to about 0.35 mm, and in some cases is preferably about 0.2 mm. For separating the sucked-in fluid 9 from the sucked-in residue 10 during the third step S3, the separator 4 may use, as described above, the cyclone-principle.

In a fourth step S4 of the method, the sucked-in residue 10 separated from the sucked-in fluid 9 may be collected in the above described bin 7. The method may further comprise a fifth step S5 of outputting the sucked-in fluid 9 separated from the sucked-in residue 10 by using the above described first and second stage separators via the pump 6 to an external environment or otherwise outside the above described cleaning device 2.

In summary, the above described method, the suction element, and the cleaning device may generally rely on the principle(s) of a vacuum cleaner. The suction mouth may be moved along the print head, causing an airflow along the nozzle plate surface and into the suction mouth. Generally, and in many cases ideally, all or substantially all residue may be removed, but a meniscus inside the nozzle(s) is not, or is not significantly, disturbed. Afterwards, the residue may be separated from the air to enable collection of the residue. Thus, methods and devices are provided allowing cleaning of a print head with a repeatable quality and generally without operator dependency or damage to the print head.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

Additionally, unless otherwise specified, as used herein, the phrases "at least one of [X] and [Y]" or "at least one of [X] or [Y]," where [X] and [Y] are different components that may be included in an embodiment of the present disclosure, means that the embodiment could include component [X] without component [Y], the embodiment could include component [Y] without component [X], or the embodiment could include both components [X] and [Y]. Similarly, when used with respect to three or more components, such as "at least one of [X], [Y], and [Z]" or "at least one of [X], [Y], or [Z]," the phrases mean that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A method for contactless cleaning of a nozzle plate of a print head, the method comprising:

providing a suction element, the suction element causing a fluid to flow along a surface of the nozzle plate and then toward the suction element for removing residue from the nozzle plate;

sucking-in, by the suction element, the fluid together with the removed residue;

separating sucked-in fluid from sucked-in residue using a separator connected to the suction element, wherein the separator comprises a cone shaped part in the middle of a cyclone chamber for creating a cyclone in the cyclone chamber;

outputting, at a first outlet of the separator, the sucked-in fluid separated from the sucked-in residue;

outputting, at a second outlet of the separator, the sucked-in residue separated from the sucked-in fluid;

collecting the sucked-in residue separated from the sucked-in fluid in a residue bin connected with the second outlet of the separator; and providing a bypass circuit parallel to the separator for generating underpressure in the residue bin such that the sucked-in residue is sucked into and collected in the residue bin from the separator via the second outlet, the bypass circuit configured to carry fluid from the residue bin, generally free of the sucked-in residue, away from the residue bin.

2. The method of claim 1, wherein the cone shaped part is housed within a substantially cylindrical cavity of the cyclone chamber, causing the sucked-in fluid and the sucked-in residue to move around the cone shaped part between the cone shaped part and the substantially cylindrical cavity to separate the sucked-in fluid from the sucked-in residue.

3. The method of claim 2, wherein the suction element is moved relative to the surface of the nozzle plate during the step of sucking-in the fluid together with the removed residue.

4. The method of claim 3, wherein the suction element is moved relative to the surface of the nozzle plate during the step of sucking-in the fluid together with the removed residue with a speed greater than or equal to about 0.5 mm/s and less than or equal to about 3.0 mm/s.

5. The method of claim 3, wherein the suction element is moved relative to the surface of the nozzle plate during the step of sucking-in the fluid together with the removed residue with a distance from the surface of the nozzle plate larger than or equal to about 0.15 mm and smaller than or equal to about 0.35 mm.

6. A cleaning device for contactless cleaning of a nozzle plate of a print head, the device comprising:

a suction element configured to:

cause a fluid to flow along a surface of the nozzle plate and then toward the suction element for removing residue from the nozzle plate; and suck-in the fluid together with the removed residue;

a separator connected to the suction element, the separator comprising a cone shaped part housed within a substantially cylindrical cavity of a cyclone chamber for creating a cyclone in the cyclone chamber configured to move sucked-in fluid and sucked-in residue around the cone shaped part between the cone shaped part and the substantially cylindrical cavity and separate the sucked-in fluid from the sucked-in residue;

a residue bin connected to an outlet of the separator for collecting the sucked-in residue separated from the sucked-in fluid; and a bypass circuit parallel to the separator for generating underpressure in the residue bin such that the sucked-in residue is sucked into and collected in the residue bin from the separator via the outlet, the bypass circuit configured to carry fluid from the residue bin, generally free of the sucked-in residue, away from the residue bin.

7. The cleaning device of claim 6, further comprising a filter device arranged downstream the separator and being connected to the separator, wherein the filter device is configured to remove aerosols from the sucked-in fluid.

8. The cleaning device of claim 7, wherein the filter device comprises an active carbon filter.

9. The cleaning device of claim 7, further comprising a pump arranged downstream the filter device and being connected to the filter device, wherein the pump is configured to discharge the sucked-in fluid to an environment external the cleaning device.

10. The cleaning device of claim 6, wherein the suction element is configured to cause the fluid to flow along the surface of the nozzle plate with a predetermined fluid velocity based on a gap surface between the suction element and the surface of the nozzle plate.

11. The cleaning device of claim 10, wherein the fluid velocity is greater than or equal to about 18 m/s and less than or equal to about 53 m/s.

12. The cleaning device of claim 6, wherein the suction element comprises a mouth piece and at least one wheel, the at least one wheel being arranged such that the mouth piece is spaced away from the surface of the nozzle plate.

13. The cleaning device of claim 6, wherein the suction element further comprises a spring system for pushing the mouth piece toward the surface of the nozzle plate.

14. The method of claim 2, further comprising providing the sucked-in fluid from the first outlet of the separator and fluid from the bypass circuit to a filter device arranged downstream the separator and bypass circuit.

15. The method of claim 2, wherein the suction element is configured for causing the fluid to flow along the surface of the nozzle plate with a fluid velocity greater than or equal to about 18 m/s and less than or equal to about 53 m/s.

* * * * *